US006866570B2

(12) United States Patent
Hunter, Jr.

(10) Patent No.: US 6,866,570 B2
(45) Date of Patent: Mar. 15, 2005

(54) VARIABLE SPEED RECIPROCATING LINEAR SLIDING DUAL FLOOR SANDER

(76) Inventor: John P. Hunter, Jr., 344 Country Rd. 39A, Southampton, NY (US) 11968

( * ) Notice: Subject to any disclaimer, the term of this patent is extended or adjusted under 35 U.S.C. 154(b) by 0 days.

(21) Appl. No.: 10/434,830

(22) Filed: May 9, 2003

(65) Prior Publication Data

US 2004/0224620 A1 Nov. 11, 2004

(51) Int. Cl.[7] ..... B24B 23/00
(52) U.S. Cl. ..... 451/351; 451/356
(58) Field of Search ..... 451/350, 351, 451/354, 356, 360, 162, 164

(56) References Cited

U.S. PATENT DOCUMENTS

| | | | | |
|---|---|---|---|---|
| 1,122,233 | A | * 12/1914 | Smith | 451/351 |
| 1,501,192 | A | 7/1924 | Severns | |
| 2,429,550 | A | 10/1947 | Hein | |
| 2,455,626 | A | 12/1948 | Traut | |
| 2,755,673 | A | 7/1956 | Dixon | |
| 2,790,276 | A | 4/1957 | Sarkis | |
| 2,830,411 | A | 4/1958 | Hartmann | |
| 3,555,743 | A | 1/1971 | Geiger | |
| 3,943,669 | A | 3/1976 | Stroezel | |
| 4,475,316 | A | 10/1984 | Dicke | |
| 4,478,010 | A | 10/1984 | Dicke | |
| 4,821,457 | A | 4/1989 | Ianuzzi | |
| 4,864,775 | A | 9/1989 | David | |
| 4,937,984 | A | 7/1990 | Taranto | |
| 5,341,605 | A | 8/1994 | Tasikas | |
| 5,575,710 | A | 11/1996 | Kramer | |
| 5,634,843 | A | 6/1997 | Liu | |
| 5,855,505 | A | 1/1999 | Letts | |
| 5,890,954 | A | 4/1999 | Barous | |
| 6,155,917 | A | 12/2000 | Tasikas | |
| 6,202,775 | B1 | 3/2001 | Mattson et al. | |
| 6,419,565 | B2 | 7/2002 | Mattson et al. | |
| 2001/0002627 | A1 | 6/2001 | Mattson et al. | |
| 2003/0022612 | A1 | 1/2003 | Barnes et al. | |

* cited by examiner

*Primary Examiner*—Dung Van Nguyen
(74) *Attorney, Agent, or Firm*—Alfred M. Walker

(57) ABSTRACT

A non-rotary, linear reciprocating floor sander includes a housing having a bottom opening, wherein a rotating electric motor is supported by the housing. A vertical output shaft extends within the housing and engages gears controlling a pair of flat platens enclosed above and on sides by the housing. The platens have lower surfaces with bonded sandpaper pads adapted to be in contact with a floor to be sanded. The vertical output shaft controls reciprocating movement of the platens linearly in a plane in opposite directions, so that the platens move toward and away from each other, thereby reducing little induced force or vibration transmitted to the housing.

8 Claims, 4 Drawing Sheets

VARIABLE SPEED RECIPROCATING LINEAR SLIDING DUAL FLOOR SANDER

BACKGROUND OF THE INVENTION

1. Field of the Invention

This invention relates to floor sanders. In particular, the present invention relates to a non-rotary, linear reciprocating floor sander with a pair of abrasive platens having coordinated opposing linear sliding movement, which avoids scrapes and visual impediments to a sanded wood floor.

2. Description of the Prior Art

Rotary based floor sanders, which typically operate with either a continuous abrasive belt or a flat rotating abrasive disc, present problems in sanding a floor. For example the rotary motions of the disc or the continuous belt are inherently aggressive, and vibrate greatly during use. Therefore the user has to constantly manually maneuver the floor sander machine as the user lowers the sander to the floor, to avoid deep gouges or scratches into the floor. This requires an expert laborer to skillfully manually manipulate the floor sander without gouging or scratching the floor being sanded.

In addition, rotary floor sanders with a continuous rotating belt, have a soft elastomeric backing, such as rubber or other elastomer behind the abrasive belt. The soft elastomeric backing bends and gives whenever the floor surface is dense, such as where a wood knot is located. As a result, the belt and the rubber backing located behind the belt, adjusts to the dense knot of the wood, goes over the knot, and grinds only the softer wood surrounding the knot. This leaves dips and valleys in the floor areas adjacent to the denser wood knots.

In addition, rotary disk sanders are limited by the radius of the rotating sanding disk, and therefore can not evenly sand the portions of the floor near the corners and edges of the floor. Also when the user of a rotating sander, whether of the continuous belt or rotary disk kind, approaches the corner or wall edge, the user must turn around and move the sander to a different position on the floor. This often causes deep scratches and imperfections in the sanded floor, which then have to be re-sanded manually, upon completion of the work with the rotary sander.

Furthermore, the rotary sanders can not easily follow the grain of the wood being sanded, in a linear direction, without excessive vibrations, which often result in scratches being dug into the floor surface.

Among patents for continuous belt rotary sanders include U.S. Pat. No. 5,341,605 of Tasikas for a dual mode floor sander, having a continuous belt of abrasive material, placed around a sanding drum, wherein the tension of the roller can be modified. In addition U.S. Pat. No. 6,155,917, also of Tasikas, describes a belt sander with a continuous sanding belt. In this patent of Tasikas '917, an extension roll is provided to minimize friction and resultant heat loss, during the sanding process. In Tasikas '917, an anti-friction surface is provided to engage the rear of the sanding belt, to allow pressure to be applied against the belt sanding the floor, without significant heat build-up due to friction.

Another continuous belt sander is noted in U.S. Pat. No. 5,575,710 of Kramer, assigned to Clarke Industries, Inc. of Springdale, Ark., for a floor sander, having a leveling mechanism, to counteract the vertical movement of the chassis and to position the axis of rotation of the sanding head, in a plane which is common within the axis of rotation of the wheels on the frame, thereby avoiding scratches due to misorientation of the floor sander.

Rotary disk sanders provide a rotating sandisk, which rotates about a vertical axis to sand a floor. However, the rotating disk is subject to vibrations and any deviation of the disk off of the vertical axis causes the edges of the sanding disk to grind non-axially into the floor, leaving deep scratches and gauging.

Among related rotary disk sanders include U.S. Pat. Nos. 6,419,565 and 6,202,775 of Mattson, as well as U.S. Patent Publication No. 2001/0002627 A1, also of Mattson, assigned to Floor Style Products, Inc. of Hastings, Mich., for rotary floor finishers which ride behind a power trailer, wherein the user is seated in a tractor-type seating orientation.

Furthermore, U.S. Pat. No. 5,890,954 of Barous describes a floor edger and sander having a rotary sanding disk, as well as an auxiliary disk float member, such as a collection of coil springs, to orient the sanding disk in a generally horizontal position as it is being moved by castors upon the floor being sanded.

U.S. Patent Publication No. US2003/0022612 A1 of Barnes describes a rotating orbital action floor sander, having a plurality of floor sanders.

In addition to the aforementioned mechanical rotating floor sanders, hand operable manual floor sanders are known, wherein the user pushes a handle of the floor sander in a reciprocating linear back and forth motion across the floor.

Among such manually operated floor sander tools include U.S. Pat. No. 1,501,192 of Severns for a floor sander and polisher, having a handle for manually pushing the floor sander across the floor, U.S. Pat. No. 2,429,550 of Hein for a hand-held cabinet finishing tool having a handle as well as a sanding block head and U.S. Pat. No. 5,855,505 of Letts for a sanding surface leveling tool, with a screw driver recess, built into the handle, for manually adjusting screws for tightening the sanding head of the tool. U.S. Pat. No. 5,634,843 of Liu describes a multifunctional grinding wiper including a longitudly extending handle and a grinding wiper for attaching grinding substrates such as emery sheets. Furthermore U.S. Pat. No. 4,927,984 of Taranto describes a hand pushed sanding block tool, having a vacuum attached thereto for removing saw dust.

The aforementioned portable floor sanding devices, either of the rotating disk or continuous belt type, or which are handheld tools, do not provide a reciprocating linear mechanical movements to be applied to the floor.

Reciprocating sanders have been known, however these sanders are typically stationary non moving stand alone machines for sanding of panels or boards, or else are hand held vibrating reciprocating sanders for sanding surface portions of wood furniture components.

However, these small hand-held sanders are not adaptable as portable, mechanical floor sanders, having reciprocating linear floor sander platens moving in opposite directions. Among such stand-alone machines include U.S. Pat. No. 4,864,775 of David for a cross-belt sanding machine having oscillatory movements. However, David '775 requires a continuous belt 12 to be operated, which has the same disadvantage as the continuous belt floor sanders.

In addition, U.S. Pat. No. 4,821,457 of Ianuzzi describes a vertical oscillating spindle sander, whereby the sander radially oscillates a non-circulatory but gyratory motion.

Another gyratory sanding machine for abrasive sandpaper material is described in U.S. Pat. No. 2,334,172 of Champayne. In addition, U.S. Pat. No. 2,455,626 of Traut describes a hand held thumb activatable sander which uses gyratory eccentric motions for converting rotary motions into reciprocating movements.

A sander is described in U.S. Pat. No. 3,943,669 of Stroezel whereby a rotary piston rotates an eccentric shaft to impart movement thereto and an eccentric configuration.

U.S. Pat. No. 2,830,411 of Hartmann describes a hand held reciprocating sanding machine. U.S. Pat. No. 2,790,276 of Sarkis Doctor Acopain describes a hand-held vibratory sanding tool, which provides a reciprocating motion of a sanding strip supporting plate, which confines the movement of the sanding strip to a straight line. Other reciprocating hand held power sanders are shown in U.S. Pat. No. 3,555,743 of Geiger and U.S. Pat. No. 2,755,673 of Dixon.

Further sanders for hand held operation, such as U.S. Pat. Nos. 4,478,010 and 4,475,316, both of Dicke, describe in-line sanders which have module housings, to influence motion of a sanding platen support, which is carried on legs, extending to a base portion, wherein the legs have a low moment of inertia in the direction of the in-line sanding, and a high moment of inertia normal to the direction of the inline sanding, so as to be causing motion in the in-line sanding path only.

However, the aforementioned in-line sanders are not directed towards a manually operated floor sander, as opposed to a hand-held sander for sanding a piece of furniture.

OBJECTS OF THE INVENTION

It is an object of the present invention to provide a floor sander, which minimizes the possibility of scrapes during sanding.

It is also an object of the present invention to provide a floor sander, which is ergonomically easy to handle.

It is yet another object minimize sawdust spreading during the floor sanding process.

It is a further object to allow a floor sander to optimize a rough grit yet minimize friction thereby making a smooth sanding of a wood floor.

It is a further object of the present invention to minimize vibrations of a floor sander.

It is yet another object to provide a floor sander, which can maximize the floor coverage area up to all wall edges and corners of the wood floor.

SUMMARY OF THE INVENTION

In keeping with these objects, and others, which may become apparent, the present invention is a variable speed, reciprocating, linear, sliding floor sander having a pair of flat platens moving in reciprocating, opposing directions. The machine preferably operates with a high revolutions per minute (RPM) speed, which can speed up or slow down movement. In a speeded up mode, this allows a rougher grit to operate faster and with less friction, thereby causing a smoother flow of the rougher grit.

The reciprocating linear sliding floor sander is preferably housed in an enclosed vacuum casing to maximize sawdust collection during use. Vibrations are minimized because of the synchronized back and forth reciprocal sliding of a pair of sanding blocks, which move back and forth alternately toward and away from each other about a pair of side, parallel oriented tracks.

The linear motion is caused by rotation of a rotary motor axle, which is joined to rotary bearings, which move about linear oriented slots, to cause linear motion of the sanding place towards and away from each other. In a preferred embodiment the plates can slide and move towards and away from each other at 4,000 times per minute, causing only a slight hum with minimal vibrations. Because of the lack of vibrations, the sanding machine of the present invention can be easily operated upon a floor to be sanded, without gouges or excessive scratches of the wood floor being caused by an overly aggressive sanding machine.

Because the two plates supporting the sanding paper or other abrasive pads are attached to flat rigid sliding members, the sanding pads can easily and equally sand down a dense wood knot, as well as the less dense grained wood fibers adjacent to the denser wood knot.

Also because of the in-line sanding motion of the sander, it can go right up to the edge of a floor being sanded, without resulting in arcuate movements, causing arcuate scratches or other imperfections in the floor being sanded.

BRIEF DESCRIPTION OF DRAWINGS

The present invention can best be understood in connection with the accompanying drawings, in which.

DETAILED DESCRIPTION OF THE INVENTION

Figure 1:
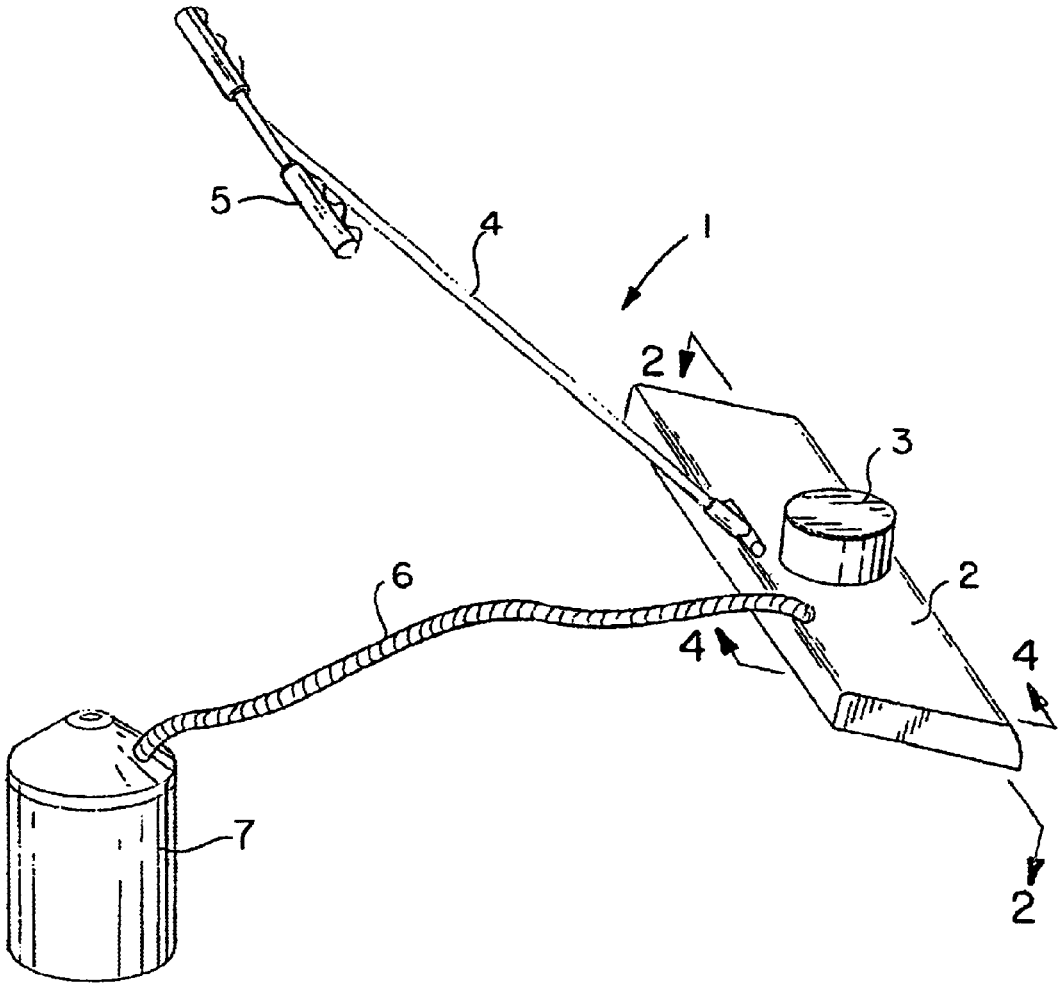
FIG. 1 is a perspective view of a dual pad linear floor sander of this invention.

FIG. 1 shows floor sander 1 of this invention with sander head housing 2 and motor housing 3. Handle 4 is pivoted at the sander head to adjust to a convenient operating height for the user. This handle 4 connection also permits easy fore and aft as well as lateral and rotating movement of the sander upon a floor surface. T-handle 5 permits an aggressive grip that leads to precise guidance. Optional vacuum hose 6 attached to SHOP VAC® 7 is used to minimize airborne dust and reduce clean up after a sanding operation. Housing 2 encloses the sanding head with just about an eight of an inch (3 mm) height clearance to the floor surface. This facilitates high air velocity around the periphery of the sanding head as created by a typical shop vacuum cleaner to efficiently entrap the wood dust.

Figure 2:
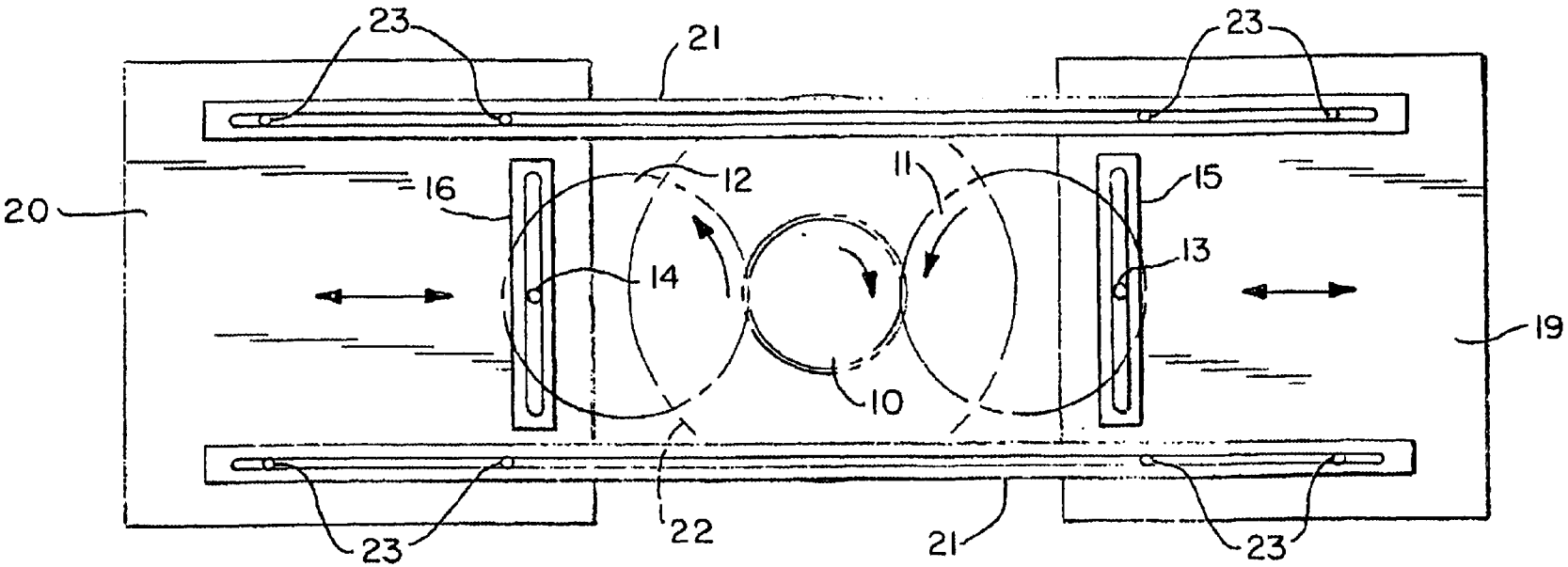
FIG. 2 is a top plan schematic view of the main operating components of the floor sander thereof, taken in the direction shown along arrows "2—2" of FIG. 1.

The operating principle of this floor sander is easily understood by studying FIG. 2 which shows a top view of the main linear motion components. Motor 22 is just shown as a dashed line outline in this view for clarity. It drives center gear 10 which meshes with drive gears 11 and 12. Drive pegs 13 and 14 attached to gears 11 and 12 respectively form a Scotch Yoke reciprocating mechanism when driving within the center grooves of slotted members 15 and 16 respectively. These latter members are attached to sand paper platens 19 and 20 respectively which are constrained to move linearly within slots in stationary members 21 via attached pegs 23. It can be understood that by rotating center gear 10 continuously in the clockwise direction, sandpaper platens 19 and 20 will be reciprocated synchronously in opposite linear directions. The Scotch Yoke drive provides smooth slowdown and reversal at the stroke limits.

FIG. 2 shows the instant at the limit of travel when platens 19 and 20 are farthest apart. This synchronous motion virtually cancels the floor-to-sanding platen forces within the structure of the sanding head since the force vectors are in opposite directions. This means that little induced force or vibration is transmitted to T-handle 5. This greatly reduces operator fatigue as compared to prior art floor sanders. Platens 19 and 20 are of rigid material and have a stiff surface to support the sandpaper. This improves the operation in achieving the desired result, a flat floor regardless of variations in local wood density (such as knots).

Figure 3:
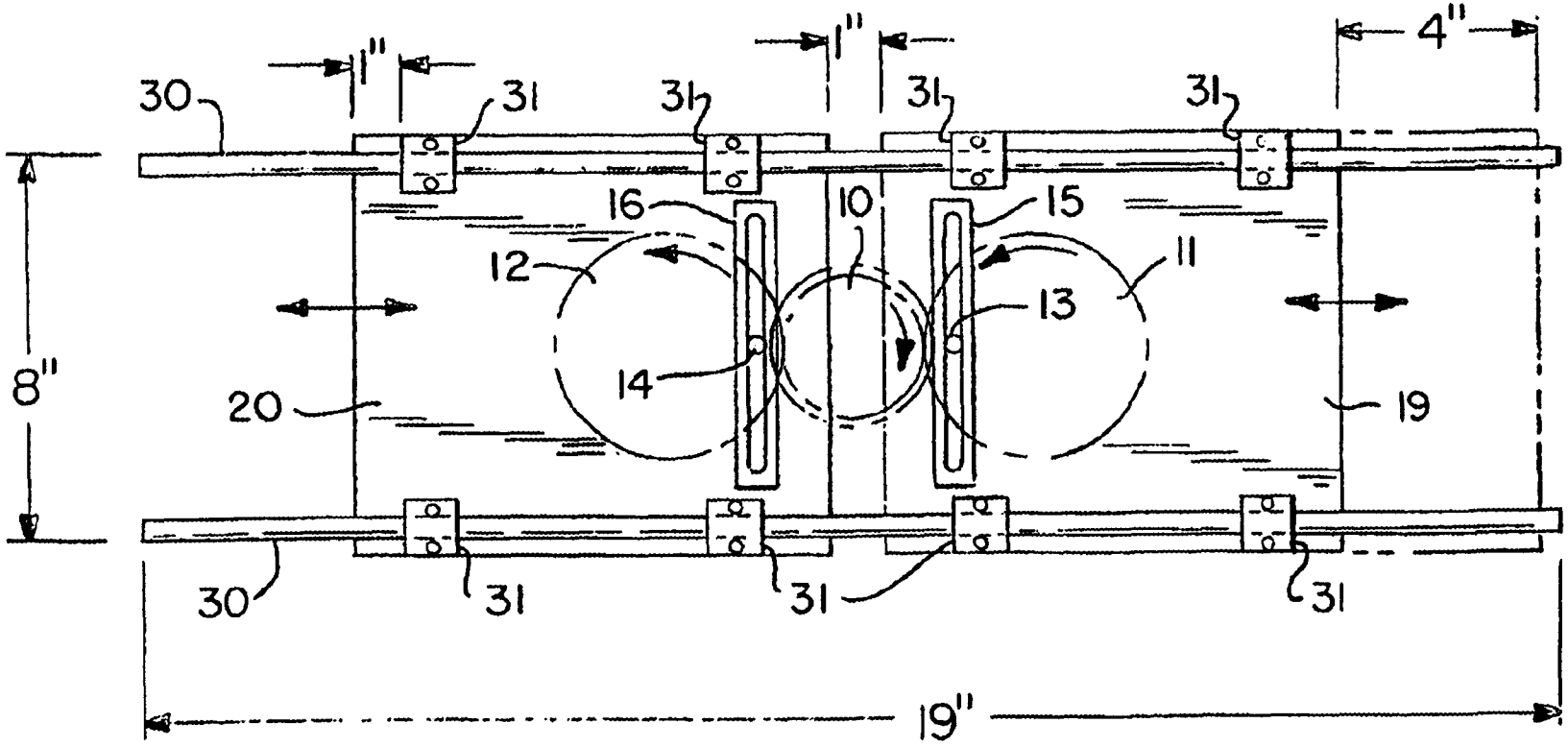
FIG. 3 is a top plan schematic view of the main operating components of an alternate preferred embodiment of the floor sander.

FIG. 3 is a similar view to FIG. 2, but it shows sanding platens 19 and 20 at their closest position. It also illustrates the preferred embodiment which uses stationary rods 30 and linear bearings 31 in lieu of slotted members 21 and pegs 23. Each platen 19 or 20 undergoes an 8" (20 cm) stroke per revolution of drive gears 11 or 12. Also, drive pegs 13 and 14 can be developed into rollers with ball or needle bearings to reduce wear and friction when operating within members 15 or 16.

Figure 4:
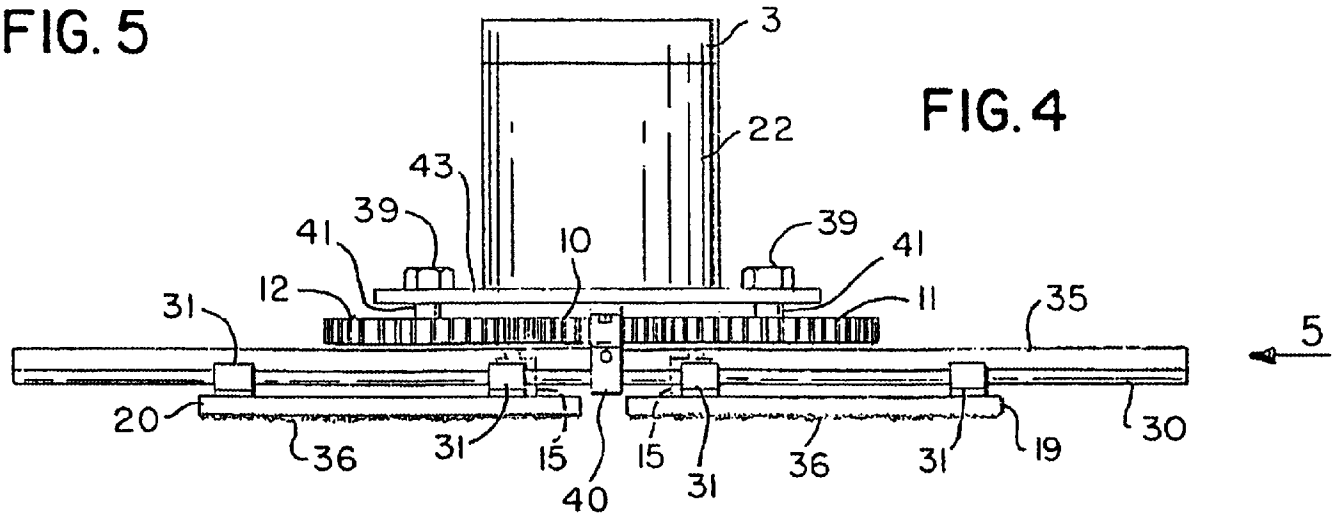
FIG. 4 is a side elevational view of the sander head with the housing removed, taken in the direction shown along arrows "4—4" of FIG. 1.

FIG. 4 is a side view of the preferred embodiment of FIG. 3. The housings have been removed for clarity.

Figure 5:
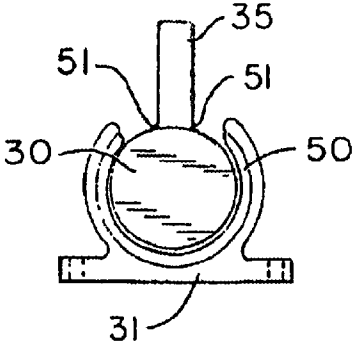
FIG. 5 is an enlarged detail end view of a guide rod thereof within a linear bearing, taken in the direction shown along arrows "5—5" of FIG. 4.

FIG. 5 is an enlarged detail showing an end view of reinforced stationary rods 30 which have a reinforcing fin 35 welded at 51. Linear bearing 31 is a metal shell (can be fabricated by extrusion) with a bonded non-metallic polymer bearing liner 50 such as the plain bearings of Freelon-GOLD® provided by Pacific Bearing of Rockford, Ill. 62115.

Figure 6:
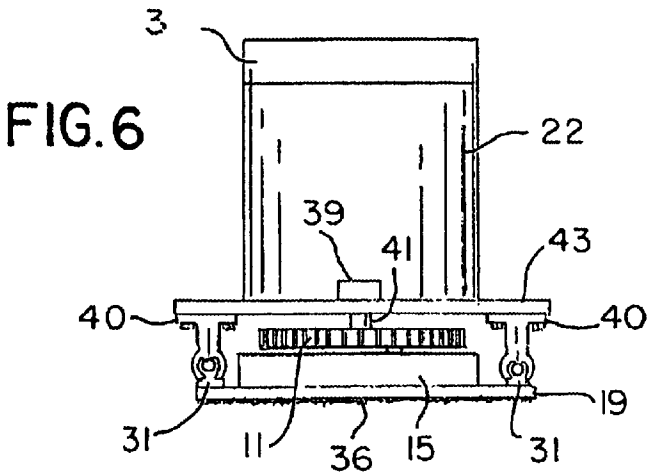
FIG. 6 is an end view of the sander head with the housing removed; as in FIG. 4; and, FIG. 7 is an electrical block diagram of the floor sander of this invention.

Alternatively, slotted linear ball bearings can be used. By using this type of reinforced rod, it is possible to simply attach them to chassis plate 43 at the center via attachment clamp 40 because of their stiffness. A locking screw goes through clamp 40 and through fin 35 to insure secure positioning. Bearings 39, attached to chassis plate 43, serve to locate drive gears 11 and 12 via short shafts 41. Sandpaper pads 36 are attached to rigid platens 19 and 20 by a temporary adhesive layer sealed by a release liner. Housing 3 atop motor 22 contains variable speed electronics. The end view of FIG. 6 is an aid in visualizing the mechanism.

A variety of motor types can be used in this floor sander. Because it is desirable to provide adjustable speed, additional electronics must be used for this feature.

Figure 7:
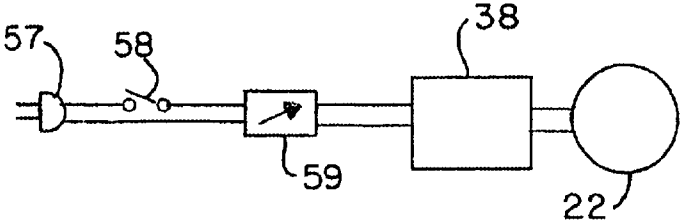

The block diagram of FIG. 7 shows wall plug 57 for attachment to AC mains, power switch 58, remote speed setting control 59, electronic variable speed driver 38, and motor 22. Switch 58 and remote speed setting control 59 can be incorporated into T-handle 5 for convenience. Control 59 can be a potentiometer operated by twisting one side of T-handle 5. If motor 22 is an AC induction motor, adjustable speed drive 38 is a variable frequency driver. If motor 22 is a brushless DC motor, speed control and driver 38 is quite different incorporating a rectifier circuit to convert the AC supply current to DC.

It is noted that other changes to embodiments of the present invention may be made to the configuration and function of the present invention without departing from the scope of the invention, as noted in the appended claims.

I claim:

1. A non-rotary, linear reciprocating floor sander comprising:

a housing having a bottom opening;

a rotary electric motor supported by said housing and having a vertical output shaft;

a pair of flat platens enclosed above and on sides by said housing, said platens having lower surfaces with bonded sand paper pads adapted to be in contact with a floor to be sanded;

means connected to said vertical output shaft for reciprocating said platens linearly in a plane in opposite directions so that said platens move toward and away from each other thereby producing little induced force or vibration transmitted to said housing;

wherein said reciprocating means comprises a center gear driven by said output shaft engaged with and driving a pair of driven gears in opposite directions, each of said driven gears driving a platen through a reciprocating mechanism;

in which each driven gear has a drive peg mounted adjacent a periphery of said driven gear, each of said platens having on an upper side thereof a slotted member for engaging a drive peg so that as said driven gears rotate each slotted member causes its platen to reciprocate.

2. The floor sander of claim 1 in which said housing has a rail engaged with said platens to constrain said platens to linear movement within said housing.

3. The floor sander of claim 2 having a handle extending from said housing for guiding said floor sander.

4. The floor sander of claim 3 in which said electric motor is mounted on tap of said housing.

5. The floor sander of claim 3 having a vacuum device connected by hose into said housing for removing airborne dust produced by sanding of said floor.

6. The floor sander of claim 5 in which said housing is adapted to enclose said platens with about a 3 mm height clearance to a surface of said floor to be sanded for efficiently entrapping and removing airborne dust.

7. The floor sander of claim 3 in which said handle is pivoted for adjustment to a convenient height for a user.

8. The floor sander of claim 2 in which said platens have bearings for engaging said rail.

* * * * *